United States Patent [19]

Bradshaw

[11] 4,256,076

[45] Mar. 17, 1981

[54] EXHAUST GAS RECYCLING MODULATOR VALVE ASSEMBLY

[75] Inventor: Cyril E. Bradshaw, Kalamazoo, Mich.

[73] Assignee: Eaton Corporation, Cleveland, Ohio

[21] Appl. No.: 50,281

[22] Filed: Jun. 19, 1979

[51] Int. Cl.[3] ..... F02B 47/08

[52] U.S. Cl. ..... 123/568

[58] Field of Search ..... 123/568, 569

[56] References Cited

U.S. PATENT DOCUMENTS

| | | | |
|---|---|---|---|
| 3,931,813 | 1/1976 | Horie et al. | 123/568 |
| 4,109,624 | 8/1978 | Washio et al. | 123/568 |
| 4,116,182 | 9/1978 | Bradshaw | 123/568 |

*Primary Examiner*—Wendell E. Burns

*Attorney, Agent, or Firm*—R. J. McCloskey; E. C. Crist

[57] ABSTRACT

A valve assembly (10) is provided for controlling the recirculation of exhaust gases in an internal combustion engine. The assembly includes a lower housing portion (20) having an exhaust gas inlet (24) and an exhaust outlet port (28). An upper housing member (30) has mounted therein an upper flexible diaphragm (48) biased by spring (72) biased a predetermined amount in an upward direction and a lower diaphragm (76) which is also biased by a spring (102) biased a predetermined amount in a downward direction. The upper and lower diaphragms define a control chamber (108) which is communicated with an engine intake manifold vacuum source. An axially movable valve member (90) is connected to the lower end of a valve stem (88) which is in turn connected to the lower diaphragm. An adjustment feature (62, 66, 98, 104) permits the preload on both of the biasing springs to be precisely adjusted in order that a desired precise exhaust gas recirculation flow as a function of intake manifold vacuum can be achieved after final assembly of the valve. An alternate embodiment of the invention incorporates a bleed valve assembly (202) responsive to exhaust gas back pressure which enables the valve to discriminate between various engine loadings.

3 Claims, 6 Drawing Figures

EXHAUST GAS RECYCLING MODULATOR VALVE ASSEMBLY

BACKGROUND OF THE INVENTION

The present invention relates to exhaust gas recirculation modulator valves for use in internal combustion engines and more particularly to those valves which recirculate engine exhaust gas at controlled flow rates in response to given engine loading and speed conditions.

DESCRIPTION OF THE PRIOR ART

Exhaust gas recirculation or recycling (EGR) modulator valves are known in the art and in the more common applications to passenger car engines function to recirculate a given percentage of exhaust gas flow into the engine intake manifold under various engine operating conditions. One widely used type of variable EGR modulator valve includes a pair of spring-biased diaphragms which are movable in response to intake manifold pressures below atmospheric pressure. In this type of device one of the diaphragms is connected to an axially movable pintle valve member which is mounted in a converging-diverging valve orifice. The degree of exhaust gas flow control is ultimately dependent upon the magnitude of the biasing spring preloads, the inherent stiffness of the diaphragms, and dimensional variations associated with component parts.

In such known types of EGR valves it has been difficult to maintain repeatability of valve performance from valve to valve due to the difficulty in controlling the tolerances on the biasing spring preload which is a function of factors such as spring rate and overall spring dimensions. In the present commercial forms of such known EGR valves, the repeatability of valve performance in large production quantities is generally no better than plus or minus 15% due to the inherent difficulty in controlling spring preload.

Another shortcoming of known variable EGR valves is their inability to discriminate between an engine cruise and an engine idle condition. This is because the intake manifold pressure level for engine cruise and idle are almost identical. It is important that the EGR modulator valves be capable of distinguishing between cruise and idle conditions because the quantity of nitrous oxide pollutants at engine cruise conditions is significantly higher and requires a greater percentage of EGR flow.

SUMMARY OF THE INVENTION

In the present invention a variable EGR modulator valve is provided having a valve pintle movable in response to intake manifold pressure and acting on pressure responsive diaphragms. The variable EGR modulator valve includes a means for adjusting the spring biasing loads on upper and lower diaphragms mounted in a valve housing cavity and which form a pneumatic control chamber within the housing. A tubular threaded adjustment member is connected to and extends through an upper housing member and functions to adjust the preload on a first biasing spring connected between a spring retainer and an annular plate connected to the upper diaphragm. A second adjustment member in the form of a set screw extends through an insert connected to the upper diaphragm and functions to adjust the preload on a second biasing spring which has its lower end connected to the lower diaphragm. This adjustment arrangement permits precise calibration of valve EGR flow by permitting each biasing spring to be independently adjusted while the valve is in final assembly and while simulated control pressures and exhaust flows are connected to the valve.

A second embodiment of the invention incorporates an exhaust gas back-pressure responsive element in a variable EGR modulator valve. The backpressure responsive element of the second embodiment includes a bleed-valve which makes the modulation of EGR flow responsive to increased loading demands on the vehicle engine during which greater amounts of nitrous oxide pollutants are formed. The backpressure sensitive bleed valve incorporates a third diaphragm having a valve sealing lip around the inner periphery thereof which is maintained in sealing engagement with a corresponding sealing surface on an outwardly extending flange located around the lower end of a tubular flow restricter. Upper and lower housing shells form in cooperation with the third diaphragm an air bleed chamber and an exhaust gas control chamber, respectively. A hollow valve stem has its upper end in fluid communication with the exhaust gas control chamber and its lower end communicating with an exhaust gas inlet orifice. Upon the exhaust gas pressure exceeding a predetermined pressure valve, the back-pressure valve vents a controlled amount of atmospheric air flow into the EGR valve control chamber which reduces the pressure level therein. The upper and lower diaphragms respond to the adjusted pressure in the control chamber and move the pintle valve member connected to the lower end of the valve stem upwardly, thereby opening the EGR valve, which results in increased EGR flow to the engine intake manifold.

It is therefore an object of the invention to provide a variable EGR modulator valve having a precise means for calibrating the valve response.

It is another object of the invention to provide a means of calibrating a variable EGR modulator valve during final assembly of the valve and including means for adjusting the modulator valve under simulated operating conditions.

It is another object of the invention to provide a variable EGR modulator valve which is responsive to varying engine loading conditions and which can discriminate between various engine loading conditions and therefore recirculate more exhaust gas at engine operating conditions during which greater amounts of nitrous oxide pollutants are formed.

It is a further object of the invention to provide a variable EGR modulator valve which has an exhaust back-pressure sensitive bleed valve integrally formed with the modulator valve power unit.

DETAILED DESCRIPTION

Figure 1:
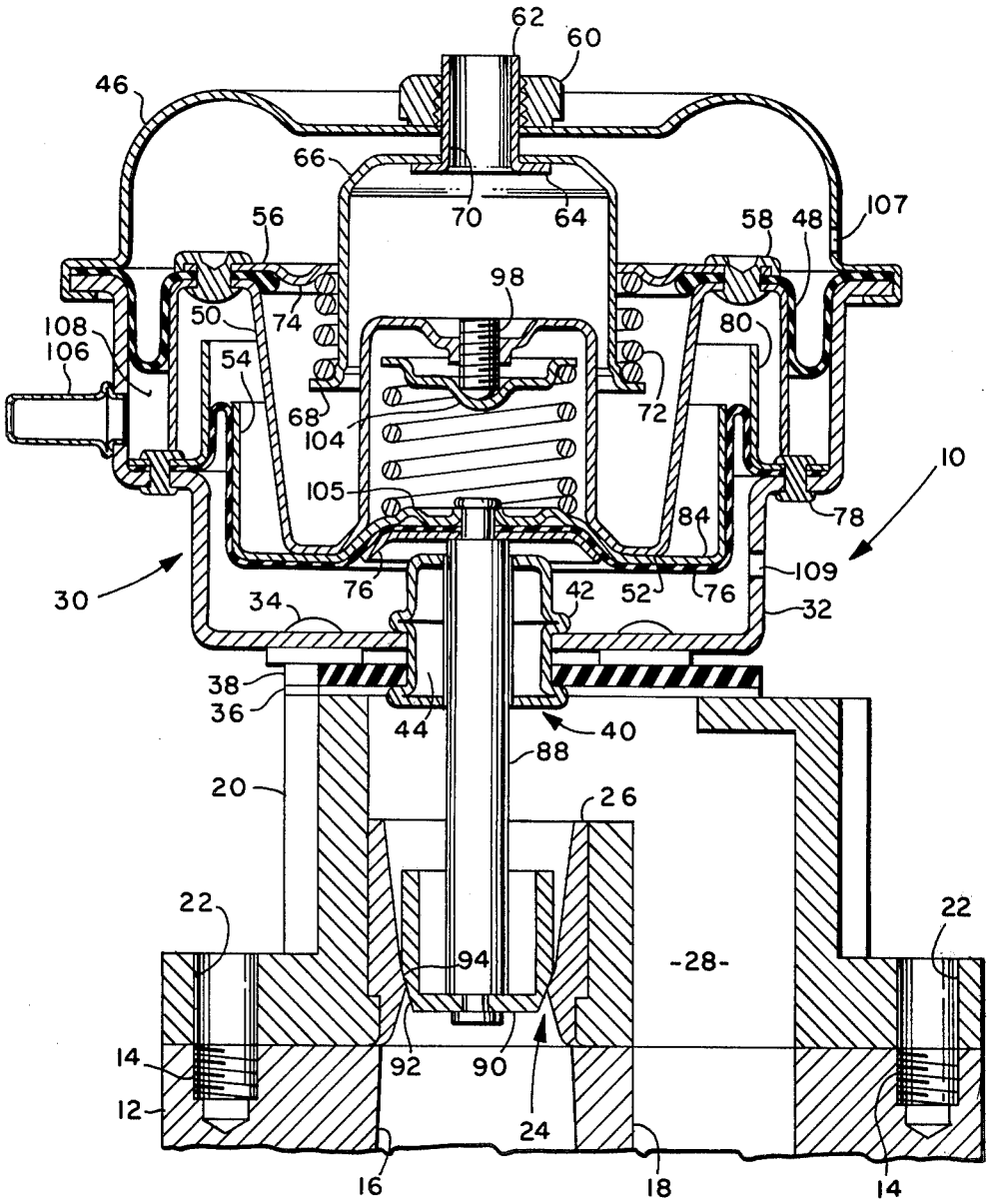
FIG. 1 is a cross-sectional view of a first embodiment of the invention as positioned during engine idle.

Referring now to FIG. 1, an exhaust gas recycling (EGR) modulator valve assembly is indicated generally at 10 and shown mounted on a manifold boss portion 12 of an internal combustion engine. The manifold boss portion includes a plurality of bolt receiving bores 14. An exhaust gas passage 16 providing pressurized fluid communication with the engine exhaust manifold, and an intake passage 18 for directing exhaust gas to the engine intake manifold.

Valve assembly 10 includes a lower housing portion 20 having a plurality of bolt mounting holes 22, an exhaust gas inlet indicated generally at 24 defined by an insert 26 having a converging-diverging passage 23 therethrough, the insert 26 being mounted in a bore 27 formed in lower housing 20. An exhaust gas outlet 28 is in fluid communication with inlet 24 and permits flow of exhaust gas to intake passage 18.

An upper housing portion, indicated generally at 30, includes a lower cup-shaped member 32 connected to lower housing 20 by means of any suitable fastener, for example screws 34. A cover plate 36 and gasket 38 are mounted intermediate lower member 32 and lower housing 20 and provide a sealed connection therebetween. A guide bearing means, indicated generally at 40, includes an outer shell 42 and a bearing member 44 contained therein. In the presently preferred practice shell 42 extends through openings in lower member 32, gasket 38, and cover plate 36 and held relative thereto preferably by deformation such as convoluting or flaring its lower end over plate 36 and a portion of its mid-section over member 32.

Upper housing 30 includes a cover portion 46 connected to the open end of member 32. A first or upper pressure responsive diaphragm 48 is clamped around its outer periphery between the flanged ends of cover 46 and cup-shaped member 32.

A thin walled metallic insert 50 is connected to the inner periphery of diaphragm 48 and defines a downwardly extending annular rib portion 52 and an outer cylindrical portion 54 for guiding the rolling movement of the diaphragm. A thin-walled plate 56 is connected around the inner periphery of diaphragm 48. Fastening means, for example rivets 58, sealingly clamp diaphragm 48 between insert 50 and plate 56.

An internally threaded nut 60 is connected to the top surface of cover 46. A tubular adjustment member 62 is threaded around its outer periphery and in threaded engagement with nut 60. An outwardly extending flange 64 is formed on the lower end of adjustment member 62. A generally cup-shaped spring retainer 66 has a lower flanged end 68 and an opening 70 formed through the upper end thereof. Retainer 66 is received over adjustment member 62 and is in abutment with flanged end 64. A first biasing spring 72 is received over and guided by retainer 66. The upper end of spring 72 is in abutment with plate 56 and its lower end is in abutment with flange 68. An annular rib 74 is formed in plate 56 and serves to guide the pressure responsive diaphragm 48 by centering plate 56 with the upper end of spring 72.

A second or lower pressure responsive diaphragm 76 is connected around its outer periphery to a shoulder formed in member 32 by suitable fasteners such as rivets 78 and a flanged diaphragm guide 80. A cup-shaped insert 84 is located over the top surface of diaphragm 76. A disk-shaped insert 77 is in contact with the lower central surface of diaphragm 76 and conforms with the contour of insert 84.

A valve stem 88 is guidedly received in bearing means 40 and has the lower end thereof extending into exhaust gas inlet 24. A pintle valve member 90 is connected to the lower end of valve stem 88 and has a tapered valve surface 92 formed around its lower end which is engageable with a corresponding tapered valve seat 94 defined by a portion of the passage 23. A spin riveted connection 96 on the upper end of valve stem 88 clamps diaphragm 76 between inserts 84 and 77. As is known in the art, axial movement of pintle valve member 90 in cooperation with the convergent-divergent inlet 24 may be controlled to provide a sonic exhaust gas velocity to be established through the inlet thereby resulting in a flow rate through the valve which is directly proportional to flow area, upstream pressure, and gas temperature and is not affected by downstream gas conditions.

An adjusting set screw 98 is threadedly received in a threaded opening in insert 50. A second biasing spring 102 has its lower end in abutment with the upper surface of insert 84 and its upper end in abutment with a cup-shaped retainer plate 104. An annular rib 105 formed in insert 84 centers the lower end of spring 102. Upon installation, the second biasing spring 102 is compressed and provides a preload of sufficient magnitude to maintain retainer 104 in abutment with the lower end of set screw 98.

A nipple 106 extends through an opening in lower member 32 and is connectable to an intake manifold vacuum source, not shown.

A control chamber 108 is defined by the space between diaphragms 48 and 76. Openings disposed in any convenient location such as aperture 107 in cover 46 and aperture 109 in lower member 32 communicate the space above diaphragm 48 and the space below diaphragm 76 with atmospheric air pressure.

Figure 2:
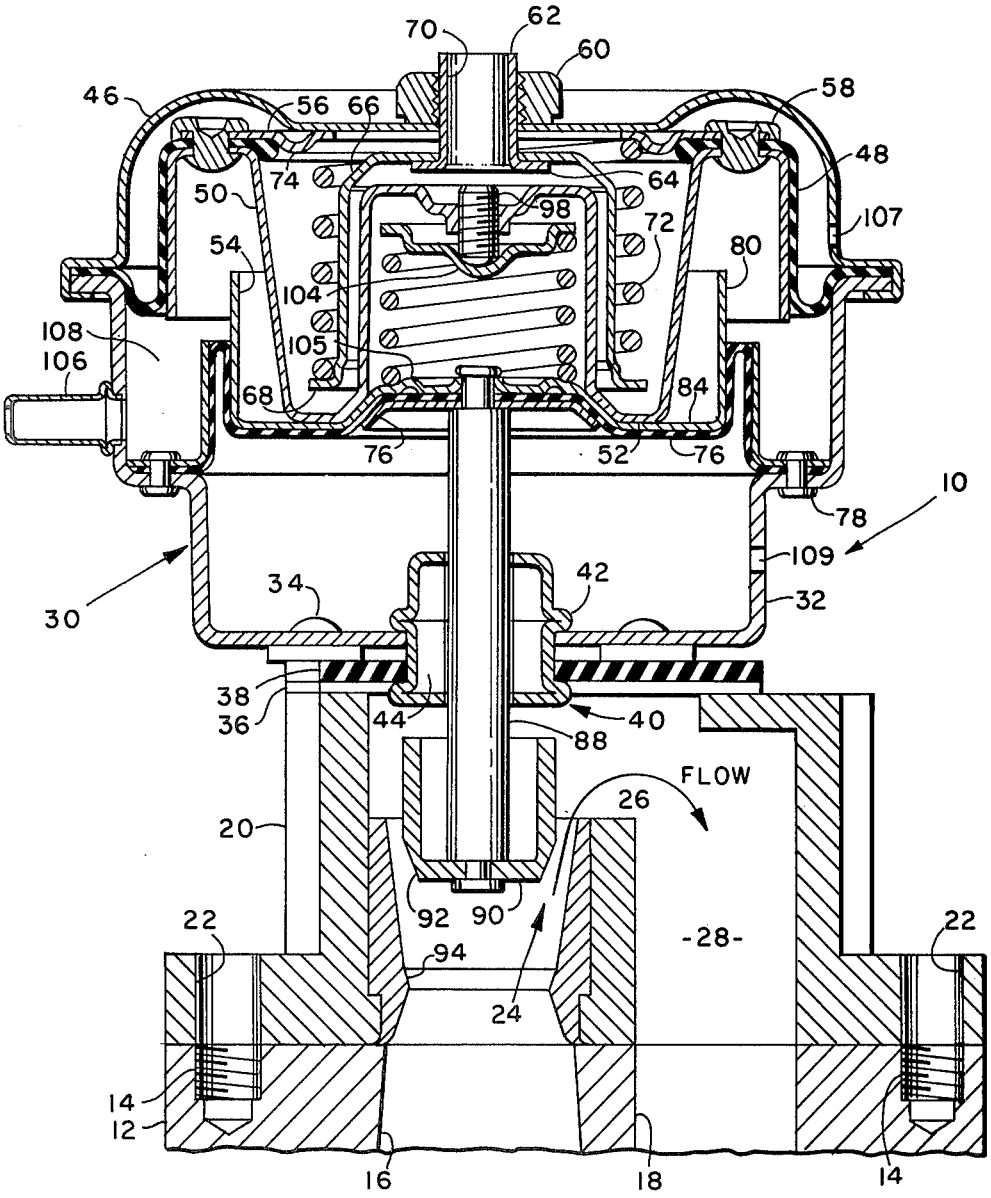
FIG. 2 is a cross-sectional view of the first embodiment similar to FIG. 1 as positioned during hard engine acceleration.
Figure 6:
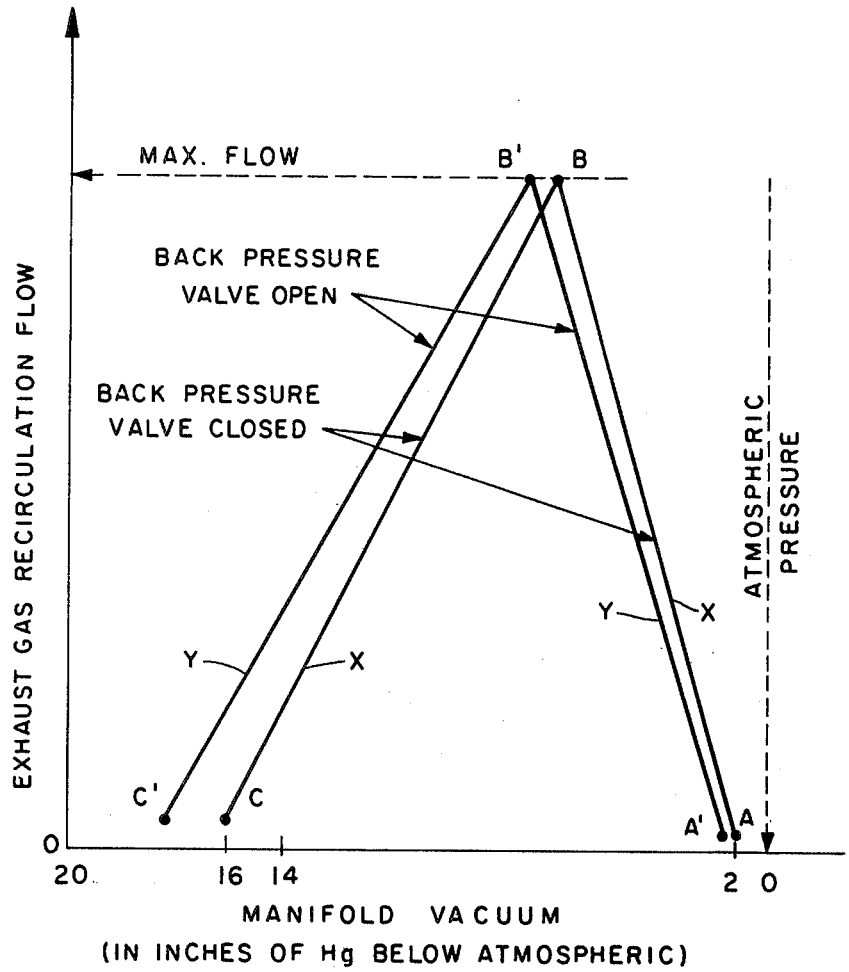

The operation of the invention modulator valve as embodied in FIGS. 1–3 will now be described. As illustrated in FIG. 6, plot X represents exhaust gas flow through valve 10 as a percentage of total exhaust gas flow plotted as a function of engine intake manifold vacuum. Point C represents a condition of engine idle, point B represents a condition of engine hard acceleration or near full throttle, and point A represents a condition of wide open throttle. The flow rates at points C and A are due to leakage flow past pintle 92. The valve position represented by FIG. 3 corresponds to point A on plot X of FIG. 6. In this "neutral" or wide open throttle engine condition, the manifold vacuum level communicated to chamber 108 is equal to approximately two inch (5.08 cm) of mercury below atmospheric pressure which permits biasing springs 72 and 102 to overcome the forces on diaphragms 48 and 76 due to the relatively low differential pressure differential pressure thereacross. At such a low level of vacuum the springs 72 and 102 move to their fully extended preload positions in which spring 72 holds diaphragm 48 against cover 46 and spring 102 holds pintle valve member 90 against valve seat 94 thereby substantially sealing off exhaust gas flow to intake passage 18. As the manifold vacuum level increases beyond point A or in a leftward direction along the abscissa in FIG. 6, the increased differential pressure across lower diaphragm 76 develops a force which overcomes the load of spring 102. Lower diaphragm 76 is thereby caused to move upwardly until the forces are balanced, thereby axially spacing pintle valve 90 a predetermined amount from valve seat 94. Diaphragm 76 will continue to move upwardly upon further increases in intake manifold vacuum (decreased manifold absolute pressure) until insert 84 abuts with rib 52 of insert 50. Prior to the pintle 90 reaching the fully open position as illustrated by FIG. 2 and as represented by point B of FIG. 6, the pressure differential across diaphragm 48 is insufficient to overcome the combined loads of springs 72 and 102 and therefore diaphragm 48 remains in the position shown by FIGS. 1 and 2.

As the intake manifold absolute pressure decreases further (increased vacuum), the differential area between the upper and lower diaphragms provides a sufficient downward load to begin overcoming the preload of spring 72 which begins to move pintle 90 once again toward a closed position as represented by point C of FIG. 6 and as represented by the FIG. 1 valve position. During valve movement from point B to point C, the upper and lower diaphragms move downwardly in unison and during which insert 84 remains in contact with rib 52.

In order to economically achieve a repeatable exhaust gas recirculation flow control device manufactured in large quantity production runs and maintain accurate control of EGR flow as a desired function of intake manifold pressure, it is necessary to precisely calibrate biasing springs 72 and 102 in order to compensate for variations in diaphragm flexibility, spring stiffness, frictional drag of stem 88 in bearing 40, and other component dimensional and material variations. The calibrating adjustment for adjusting the preload on springs 72 and 102 enables calibration to be quickly and easily made during valve final performance testing while flow through the valve is taking place. By advancing or retracting tubular member 62 the preload on first biasing spring 72 can be precisely adjusted to achieve a given diaphragm position for a given intake manifold pressure.

In the valve as embodied in FIGS. 1–3, spring 72 is calibrated by first connecting chamber 108 and inlet 24 to a pressure source (vacuum) of 8 inches (20.3 cm) of mercury below atmospheric pressure and adjusting member 62 until a flow rate of 28 cubic feet per minute is achieved through passageway 28. Adjustment of spring 102 is then made by connecting chamber 108 and inlet 24 to a pressure source of 4 inches (10.15 cm) of mercury below atmospheric pressure and adjusting member 98 until a flow rate of 28 cubic feet per minute is attained through passageway 28.

Figure 3:
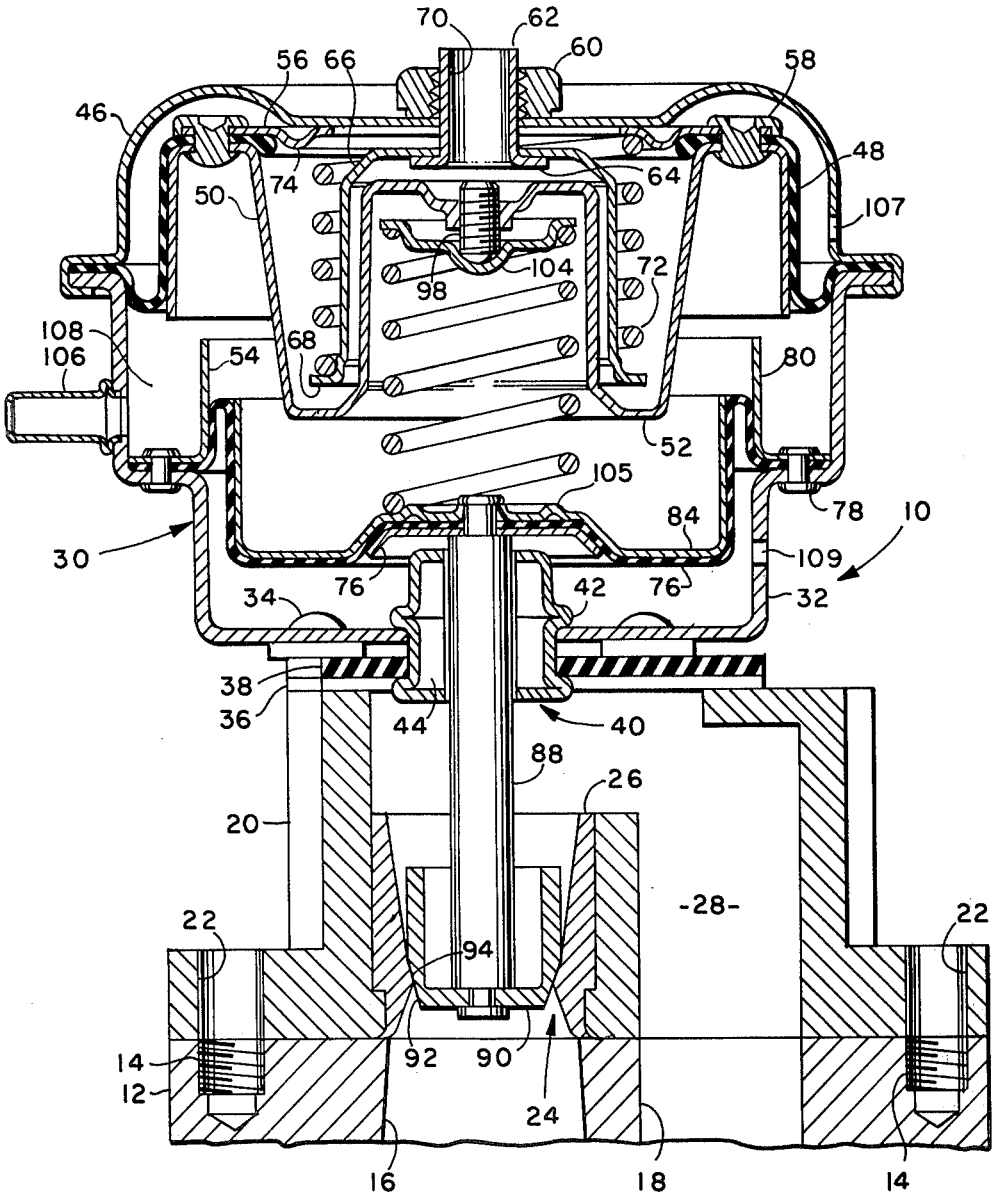
FIG. 3 is a cross-sectional view of the first embodiment similar to FIG. 1 as positioned during engine wide open throttle.
Figure 4:
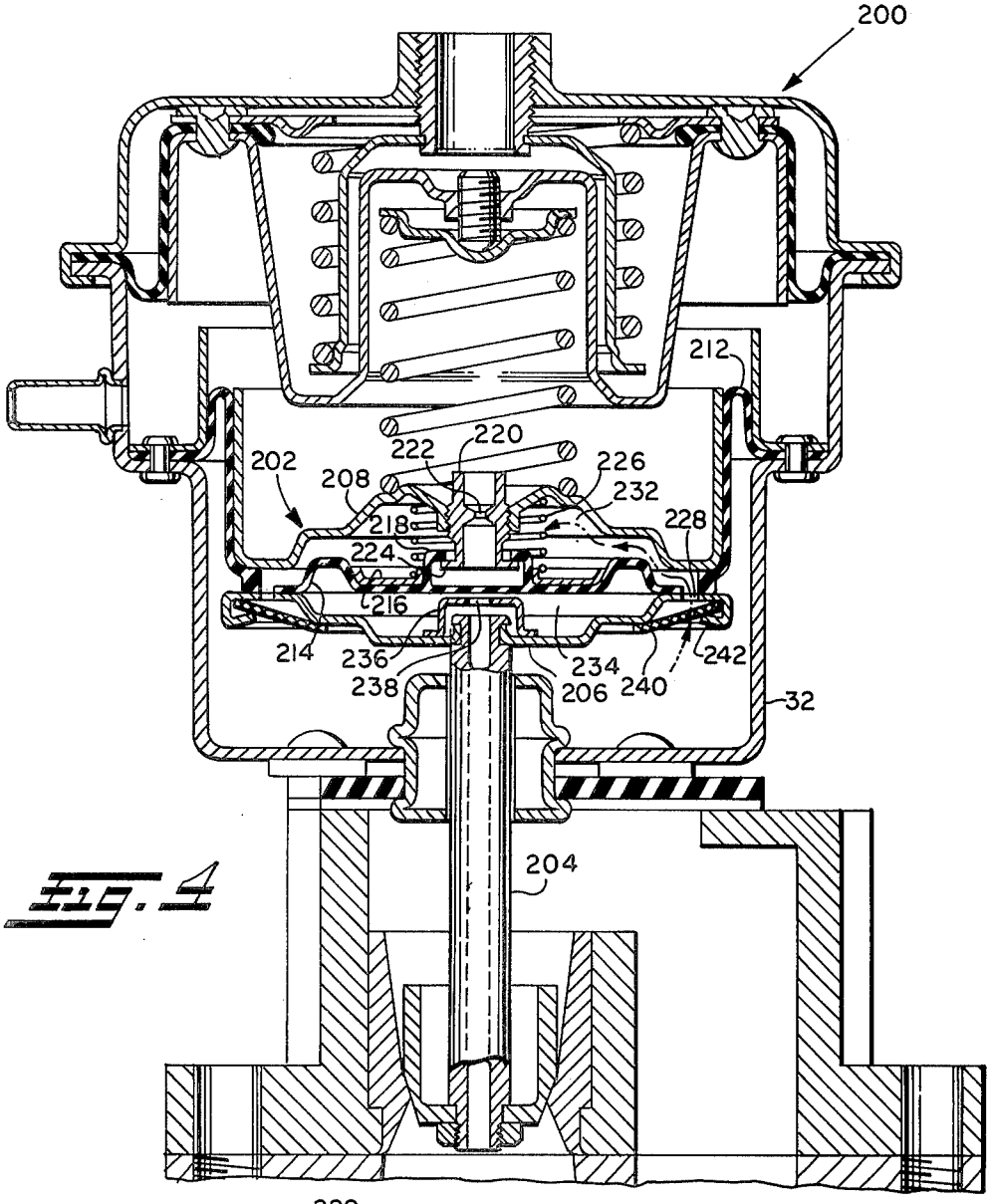
FIG. 4 is a cross-sectional view of a second embodiment of the invention incorporating a back-pressure transducer controlled bleed valve illustrated in a closed position.
Figure 5:
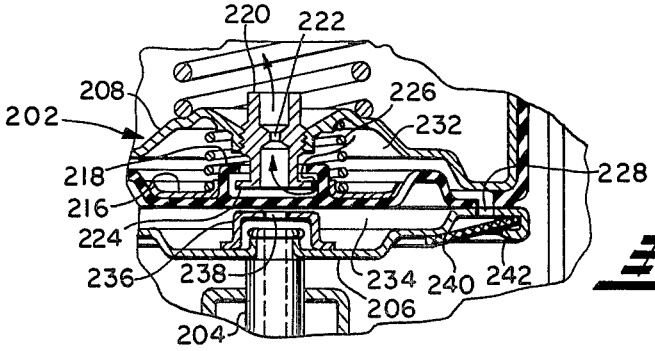
FIG. 5 is a partial cross-sectional view of the second embodiment illustrating the transducer controlled bleed valve in an open position; and, FIG. 6 is a graph of percentage exhaust gas flow versus engine load as represented by manifold vacuum in inches of mercury with plot X representing performance with the bleed valve open and plot Y with the bleed valve closed.

Referring now to FIGS. 4 and 5, an alternate embodiment of a variable EGR valve is indicated generally at 200 and is similar to the invention as embodied in FIGS. 1 through 3 but has added thereto an exhaust gas back pressure responsive valve assembly indicated generally at 202 and a hollow valve stem 204 which has its lower end in fluid communication with exhaust gas pressure. Exhaust back pressure valve assembly 202 includes a second or lower housing shell 206 and an upper housing shell 208 formed integrally by lower insert 210. Valve assembly 202 is movable with the second or lower diaphragm 212 which corresponds to diaphragm 76 of FIGS. 1–3.

A third pressure responsive diaphragm 214 is located intermediate the upper and lower housing shells 206, 208. The outer periphery of third diaphragm 214 and the inner periphery of diaphragm 212 are clamped in position between the upper and lower housing shells by means of any suitable expedient, as for example, rivets, not shown. An annular insert 216 is connected to the top surface of diaphragm 214. A sealing lip 218 is formed around the inner periphery of diaphragm 214 and is adapted for sealing contact with a corresponding valve set member.

A flow restricter 220 is connected to a central opening 221 in insert 210 and defines a flow restricting orifice 222 and a flange portion 224 extending outwardly from the lower end thereof. The upper surface of flange 224 functions as a valve seat while the lower surface of sealing lip 218 functions as a movable valve member and is in contact with the upper surface of flange 224 in the closed position for the exhaust back pressure valve.

A third biasing spring 226 is located intermediate upper housing shell portion 208 and insert 216 and functions to urge plate 216 downwardly until sealing lip 218 registers against the valve seat formed by the upper face portion of flange 224 thereby biasing exhaust back pressure valve 202 to the closed position.

An atmospheric air bleed chamber 232 is defined by the space between upper shell 208 and diaphragm 214. A plurality of openings 228 are formed through the outer periphery of lower housing shell 206 and disposed in circumferentially spaced arrangement thereabout. A plurality of radially extending passageways 230 are formed into the lower surface of diaphragm 212 adjacent its inner edge with each of the radial passageways 230 in fluid communication with one of the openings 228.

The radially extending passageways 230 communicate with the atmospheric chamber 232. A second control chamber 234 is defined by the space beneath diaphragm 214 and lower housing shell 206. A support member 236 is connected over the top end of hollow valve stem 204. A plurality of passageways 238 are formed in support member 236 and permit exhaust gas flow from hollow stem 204 to be communicated to second control chamber 234. An annular shaped filter element 235 is connected to lower shell 206 and is aligned over passageways 228 for filtering atmospheric air which flows into bleed chamber 232. The outer peripheral portion 242 of shell 206 is turned over filter 235 and functions to retain the filter in position. Atmospheric air flow to air bleed chamber 232 thus follows a path through filter 235, orifice 228, passageway 230 and into chamber 232.

The preload on spring 226 is sized to permit upward movement of diaphragm 214 upon the exhaust gas pressure in chamber 234 rising above a predetermined amount. As shown in FIG. 5, when the exhaust gas pressure in chamber 234 exceeds that predetermined amount, diaphragm 214 is moved upwardly spacing sealing of lip 218 from flange 224 and permitting atmospheric air flow to bleed through restricter orifice 222 and into control chamber 232. FIG. 5 illustrates diaphragm 214 moved upwardly placing the valve surfaces of sealing lip 213 and 224 in the open position. The black arrows represent the flow path into chamber 232 and restrictor 222.

In operation, the invention as embodied in FIGS. 4 and 5 enables variable EGR modulator valve assembly 200 to discriminate between engine idle and certain road-load cruise conditions. The ability to discriminate between different engine load conditions is provided by a diaphragm 214 sensing exhaust gas back pressure. Back-pressure valve 202 remains closed at idle but when the back pressure exceeds a predetermined amount designated a switch point, atmospheric air is communicated to the control chamber resulting in two exhaust gas recirculation flows for a given manifold vacuum signal. In the present practice a switch point of around 9 inches (22.8 cm) of $H_2O$ pressure above atmospheric) is employed. When back pressure valve 202 is closed, EGR valve 200 functions in a manner identical to that of EGR 10 of FIGS. 1–3 and the same functional description given above applies for both valves. Similarly, points "A", "B", and "C" on plot "X" of FIG. 6 would apply to valve 200 as long as back pressure valve 202 is closed.

If the exhaust gas back pressure exceeds the switch point valve, back pressure in hollow stem 204 is communicated to the second control chamber where it acts on the bottom face of diaphragm 214 and lifts the diaphragm thereby overcoming the biasing force of spring 226. During this time atmospheric air is communicated to bleed chamber 232 through the pathway described above where it enters the control cavity and reduces the vacuum level therein. At the idle position on the graph of FIG. 6, represented by point C, the EGR modulator valve 200 is closed under the load generated by the 16 inches (40.64 cm) of mercury engine manifold vacuum pressure. Since the backpressure valve assembly 202 is also closed, the pressure within the control chamber between the upper and lower diaphragms and the incoming manifold vacuum pressure through nipple 106 are identical. If, however, the manifold vacuum signal communicated through the nipple of FIG. 5 remains the same but the back pressure exceeds the set point value, then a controlled amount of atmospheric air flows into the control cavity and reduces the vacuum level to 14 inches (35.56 cm) of mercury. The reduced pressure load will permit EGR valve unit 200 to move to the open position and permit exhaust gas recirculation flow. EGR valve 200 is thus capable of two flow values for any given manifold vacuum level, depending upon the exhaust gas back pressure as is shown by the graph of FIG. 6. Valve 200 flow versus manifold vacuum with back pressure valve assembly 202 open is represented by plot Y with points C', B', and A' corresponding to engine idle, hard acceleration, and wide open throttle, respectively. Orifice 222 has also been sized to decrease bleed flow as the engine load approaches wide open throttle, thus conserving manifold vacuum at a critical stage in engine operation.

Further modifications and alterations will become obvious to those skilled in the art without departing from the spirit of this invention, and it is understood that this invention is not limited to the specific embodiment set forth herein before but encompasses that which is defined by the following claims.

I claim:

1. An exhaust gas recycling modulator valve assembly for use with an internal combustion engine, said assembly comprising:

(a) housing means including means defining an exhaust gas inlet and an exhaust gas outlet and means defining a fluid pressure chamber and an inlet therefor adapted for connection to a source of fluid pressure;

(b) an EGR valve member disposed for movement with respect to said housing means for controlling flow of exhaust gas from said exhaust inlet to said exhaust outlet;

(c) means responsive to the pressure in said fluid pressure chamber and operable to move said valve member;

(d) means defining an exhaust gas pressure chamber and an inlet communicating said exhaust gas chamber with said exhaust gas inlet;

(e) bleed valve means including a movable member and operable in an open condition to communicate said fluid pressure chamber with the atmosphere and in a closed condition to seal said fluid pressure chamber from the atmosphere; and (f) means movably responsive to the pressure in said exhaust gas chamber and operable to open said bleed valve only when said exhaust gas pressure in said exhaust gas inlet exceeds a predetermined value and close said bleed valve when said exhaust gas pressure is less than said predetermined value.

2. In an exhaust gas recycling modulator valve assembly for controlling the recirculation of exhaust gases between the exhaust manifold and the inlet manifold of an internal combustion engine, said valve assembly being of the type including a pressure responsive diaphragm assembly operative to move a recirculation valve in response to the pressure level in a control chamber defined by said diaphragm assembly, the improvement comprising (a) means defining an exhaust gas pressure chamber and an inlet communicating said exhaust gas chamber with said exhaust gas inlet;

(b) bleed valve means including a movable member and operable in an open condition to communicate said control chamber with the atmosphere and in a closed condition to seal said control chamber from the atmosphere; and (c) means movably responsive to the pressure in said exhaust gas chamber and operable to open said bleed valve only when said exhaust gas pressure in said exhaust gas inlet exceeds a predetermined value and close said bleed valve when said exhaust gas pressure is less than said predetermined value.

3. The improvement as defined in claim 2, wherein said bleed valve means includes flow restrictor means for controlling the flow rate of atmospheric air into said control chamber.

* * * * *